US010202794B1

(12) United States Patent
Careri

(10) Patent No.: US 10,202,794 B1
(45) Date of Patent: Feb. 12, 2019

(54) VINYL JAMB SYSTEM

(71) Applicant: Giovanni Careri, Vaughan (CA)

(72) Inventor: Giovanni Careri, Vaughan (CA)

( * ) Notice: Subject to any disclaimer, the term of this patent is extended or adjusted under 35 U.S.C. 154(b) by 0 days.

(21) Appl. No.: 15/706,945

(22) Filed: Sep. 18, 2017

(51) Int. Cl.

| | |
|---|---|
| ***E06B 1/34*** | (2006.01) |
| *E06B 1/08* | (2006.01) |
| *E06B 1/30* | (2006.01) |
| *E06B 1/32* | (2006.01) |
| *E06B 1/52* | (2006.01) |

(52) U.S. Cl.
CPC ..... *E06B 1/34* (2013.01); *E06B 1/08* (2013.01); *E06B 1/30* (2013.01); *E06B 1/32* (2013.01); *E06B 1/52* (2013.01)

(58) Field of Classification Search
CPC ..... E06B 1/34; E06B 1/30; E06B 1/52; E06B 1/08; E06B 1/32
USPC ..... 52/210, 204.1, 656.4, 364, 211, 288.1, 52/212
See application file for complete search history.

(56) References Cited

U.S. PATENT DOCUMENTS 4,730,380 A * 3/1988 Minter ..... E06B 1/006 29/428
5,058,323 A * 10/1991 Gerritsen ..... E06B 1/34 49/460
5,182,880 A * 2/1993 Berge, Jr. ..... E06B 1/34 49/460
5,210,986 A * 5/1993 Hagemeyer ..... E06B 1/62 49/501
5,651,222 A * 7/1997 Bridges ..... E06B 1/34 52/211
5,758,458 A * 6/1998 Ridge ..... E06B 1/045 49/504
5,836,118 A * 11/1998 Thornton ..... E06B 1/045 52/204.1
6,125,605 A * 10/2000 Young ..... E06B 1/34 52/211
6,343,438 B1 * 2/2002 Boldt ..... E06B 1/32 49/504
6,453,631 B1 * 9/2002 Headrick ..... B29C 44/12 49/504
7,204,059 B2 * 4/2007 Schiffmann ..... E04G 21/30 49/460
7,472,519 B2 * 1/2009 Careri ..... E06B 1/32 160/98
9,784,029 B2 * 10/2017 Grondin ..... E06B 1/045
2014/0069019 A1 * 3/2014 Back ..... E06B 7/22 49/484.1
2016/0230447 A1 * 8/2016 Grondin ..... E06B 1/045

* cited by examiner

*Primary Examiner* — Joshua K Ihezie

(57) ABSTRACT

A plastic cladding for a wooden frame for a building opening, the wooden frame having at least a top frame component, and respective side frame components on opposite sides of the opening, and having a plurality of cladding components, which can be selectively and separately attached to the wooden frame components, including: an interior cladding component, an exterior cladding component, an interior rectangular channel extending along an edge of the interior cladding component, and an exterior rectangular channel extending along an edge of the exterior cladding component.

12 Claims, 8 Drawing Sheets

VINYL JAMB SYSTEM

FIELD OF THE INVENTION

The invention relates to door frames having a wooden core and a synthetic shell, in which several shell components enclose and protect the wooden core of each frame component, and provide a uniform weatherproof exterior appearance. Also the combination and innovative design of the different vinyl components allow easy frame assembly and provide clean modern frame look and great flexibility for various jamb sizes.

BACKGROUND OF THE INVENTION

In many forms of construction in particular residential building construction, wood is used to construct door frames. It is common to provide the doors themselves of composite construction. The core of the door may be wood or polyurethane foam or a combination, and in many cases an outer door covering is made of metal. Such doors can be made to standard dimensions.

However the door frames into which such doors are hung, whether of solid wood or composite construction, must be built into the fabric of the building itself. It is often found that the door frame must be adjusted to accept the standard dimensions of the door. Wood door frame components, such as were used in the past, were supplied, in many cases as a kit of components, top and side components with various trim formations. Bottom frame components or so called thresholds or door sills were also provided in many cases. These door frame components were then fitted to and attached to the building fabric. Often the use of edge fillers, wedge pieces and the like, was required to provide a door frame of the correct dimensions to accept a standard door.

This work was time consuming. In the case of outside doors, connecting between the interior of the building and the outside, when once erected the door frame exterior was finished with wood preservative, and several coats of undercoat and exterior coats of paint.

Over time, the exposure to weathering would require repainting of the wooden door frame.

Eventually the wood might deteriorate and require to be removed and replaced.

It will be understood that door frame components were also supplied for interior doors located within the building from one room to another. Interior door frames were not usually a problem since they were not exposed to the elements, and in most cases did not require weather stripping. Door frames might incorporate a stop or ledge against the door would close, or at least an additional trim might be secured to the door frame after it was erected so as to provide a stop.

It is helpful therefore to understand that in this discussion, dealing mainly with doors on the outside of a building, the use of the words "interior" and "exterior" will be confined to the direction in which the door is swung open or swung closed. The portion of the door frame on the side where the door would swing open will be referred to as the interior. The portion of the door frame which will be beyond the door stop when the door is closed will be referred to as the exterior portion of the frame.

Most door frames supplied today will incorporate an interior portion, which will be of thinner wood, and an exterior portion which will be thicker. In this way, the door frame itself is milled with a shoulder, formed by the thicker exterior portion so as to provide its own integral door stop.

It has been the practice to provide at least in the case of doors on the outside of the building, a door frame cladding of synthetic material, typically PVC material, to enclose and protect the wooden door frames components.

In some cases however, the home owner will prefer to have some of the wood frame exposed, perhaps on the interior, and sometimes on the exterior as well.

In other cases, the supplier of the wood components might wish to offer the components to builders, with various different options of cladding.

Where cladding material is used to cover the wooden door frame components, then it is also desirable to provide additional trim cladding components, of the same material as the cladding, to fit the building fabric around the door opening.

One such system is shown in U.S. Pat. No. 7,472,519 Inventor Giovanni Cared issued Jun. 6, 2009. The system disclosed in the patent was a considerable improvement over earlier cladding systems, but still lacked the adaptability to accommodate the wishes and desires of the purchaser of the building, and also of the building designer.

In earlier systems, the door frames were simple planks, without the incorporation of the integral milled door stops. The door stop might be simply a piece of wood trim secured to the wooden core. The cladding might be applied to one of the portions of the door frame. In this system, however, the cladding was applied as an extension of the wooden core itself. The cladding in that case was intended to provide the shoulder or door stop against which the door would close. This system was not readily applicable to door frames in which the wooden core was milled so as to provide integral door stop shoulders.

Accordingly it is desirable to provide a cladding system in which various standard synthetic frame cladding components can be mass produced, typically by extrusion, and which cladding components can then be used selectively, or together, on the wood frame components depending on the wishes of the builder, or of the home owner or prospective buyer.

Preferably such a system can be adjusted to accommodate variations in the design of the doorway. Various spacer assembly components can be provided, which can be associated together to provide a door frame, which will accept a door of standard dimensions.

While reference has been made to a door frame, the invention is also applicable to building openings which will be filled with a fixed window pane or indeed the space between a doorway, and the remainder of a building fabric which may be filled with a panel of building fabric. In these cases of course it will be appreciated that there may be no need for a stop member since a window, or building panel may be fixed permanently in position. The cladding assembly system of the invention is applicable to wooden frames for enclosing such a building opening.

BRIEF SUMMARY OF THE INVENTION

A plastic cladding for a wooden frame designed for a building opening, the wooden frame having at least a top frame component, and respective side frame components on opposite sides of the opening, each component defining building interior wooden component portions and exterior wooden component portions, and a plurality of cladding components, which can be selectively attached to the wooden frame components, and comprising: an interior cladding component, for at least a portion of said interior core portion of said wooden frame; an exterior cladding component, separate from the interior component for at least portion of said exterior core portion of said wooden frame; an interior rectangular channel extending along one edge of said interior cladding component for fitting around a rectangular portion of said interior wooden core component; and, an exterior rectangular channel extending along an edge of said exterior cladding component, and enclosing a rectangular edge of said exterior wooden core component.

Preferably the interior cladding component defines a facing wall, and a shorter channel side wall of a first length and a longer channel side wall of greater length than the shorter channel side wall.

Preferably the shorter channel side wall defines a lock corner, having a hook wall.

Preferably the hook wall of the lock corner is co-planar with the outer surface of the wooden core.

Preferably the longer channel side wall extends across substantially the full extent of the inwardly directed surface of the interior portion of the wooden core and a rectangular flange is formed at the end of the longer channel side wall.

Usually, the wooden core will be milled so as to define a thinner building interior core portion and a thicker exterior wooden core portion, and defining a stop or shoulder formed between the two core portions, against which the door may be closed.

Preferably a hollow tubular cladding portion having an exposed cladding wall is provided for extending over the extent of the exposed exterior thicker wooden core portion. Preferably the hollow tubular cladding portion terminates in a T-shaped wall, lying co-planar with the surface of the wooden core.

Preferably one arm of the T-shaped wall defines a hook, and a locking channel. The other arm of the T-shaped wall overlaps the corner of the wooden core.

Preferably there is some form of retention means formed in the shoulder of the thicker wooden core portion, such as a groove in the wooden core portion.

Usefully, the wooden frame may surround an opening for a window pane or sidelite and provide support for the window frame, or provide support for a building panel. In some cases, the two wood jambs of the door and the sidelite are placed side by side in the assembly process. The door is one separate frame and the sidelite is another separate frame. The two frames are attached to each other for easy and flexible assembly procedures and they support each other as well.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 2:
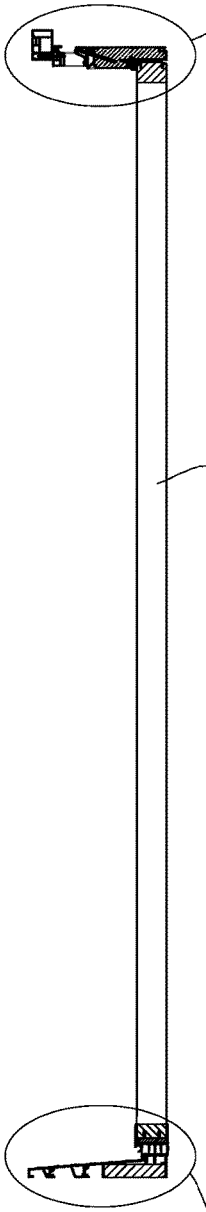
FIG. 2 is a sectional elevation of the door and door frame of FIG. 1 along line 2-2.
Figure 1:
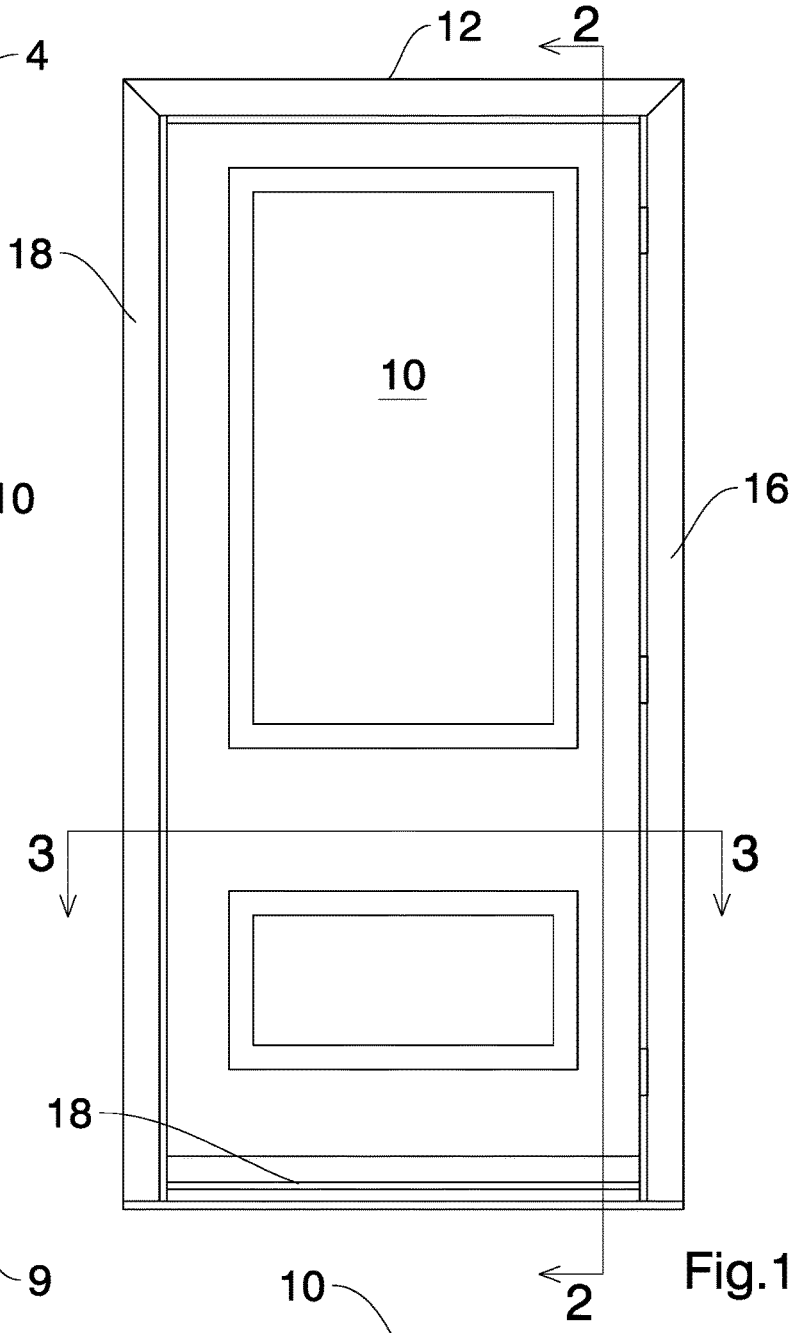
FIG. 1 is a front elevation of a typical door, and door frame illustrating an embodiment of the invention.
Figure 3:
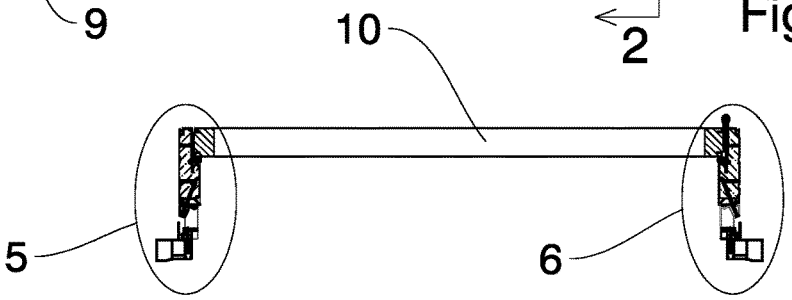
FIG. 3 is a section of the door and door frame of FIG. 1 along line 3-3.
Figure 22:
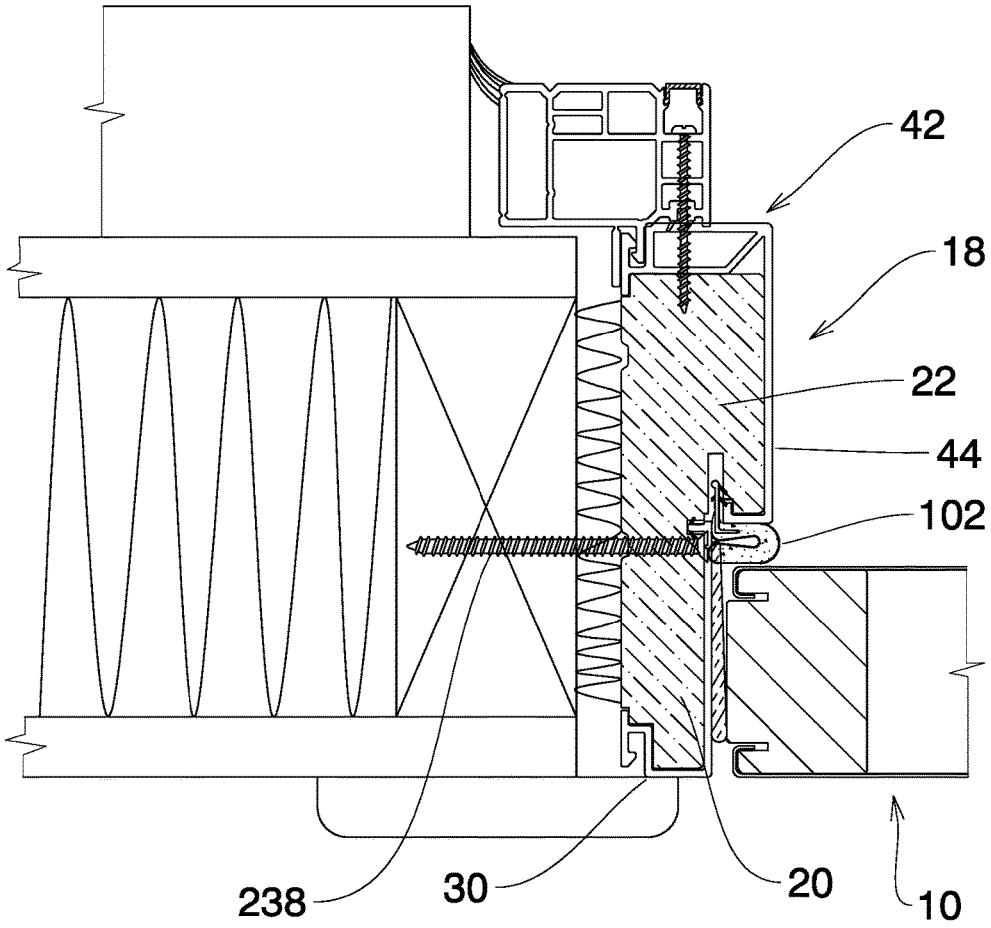
FIG. 22 is a section showing part of a typical building fabric environment with door frame/trim installation.

FIGS. 1, 2 and 3 are shown merely to illustrate the environment of the invention in general, and FIG. 22 illustrates part of a typical building fabric environment with door frame installation conditions.

FIG. 1 is a front elevation of the typical door (10) and a door frame in which the door is hung is indicated generally as top frame component (12), bottom or threshold frame component (14), hinge side frame component (16), and open side frame component (18).

In the past the wooden frame components were usually machined and milled to provide the appearance required by the builder. In some cases, the wooden frame components were simply planar planks, which were secured to the building fabric around the opening. Separate trim portions were secured to the wooden planks to provide door stops. It is, however, the preferred practise to provide prefabricated milled wooden frame components which incorporate integral door stops, and which define interior wooden core portions and exterior wooden core portions.

At the building site they would then be fastened to the building fabric (FIG. 22) around the doorway opening in the building. In more recent times the practice has been to provide a form of synthetic cladding material typically PVC. This would provide door frame components which were essentially protected from weathering.

As explained above this was not always convenient or desirable either to the customer or to the company building the homes.

All of this is very well known in the construction industry and has been the practice for years.

Given a suitable cladding composition, painting was always an option if desired. However, the provision of such cladding was not always desired by a customer, or even possibly by a designer of buildings. In some cases customers, and possibly designers also, would prefer to provide at least the appearance of wood door frame components in the interior of the house.

In some cases it would be possible that the door frame components might also be preferred in wood for the exterior. In order to provide all these options, the present invention provides a plurality of cladding components, which can be selectively attached to the wooden door frame components.

In addition, door frames around the outside at least of the building are provided with additional trim pieces where the door opening might require additional trim pieces or extensions to provide coverage between the outside of the building fabric and the door frame.

These trim and extension components will desirably inter fit with the door cladding on the door frames themselves so that cladding parts can be inter fitted together and then appear as a single component.

Figure 4:
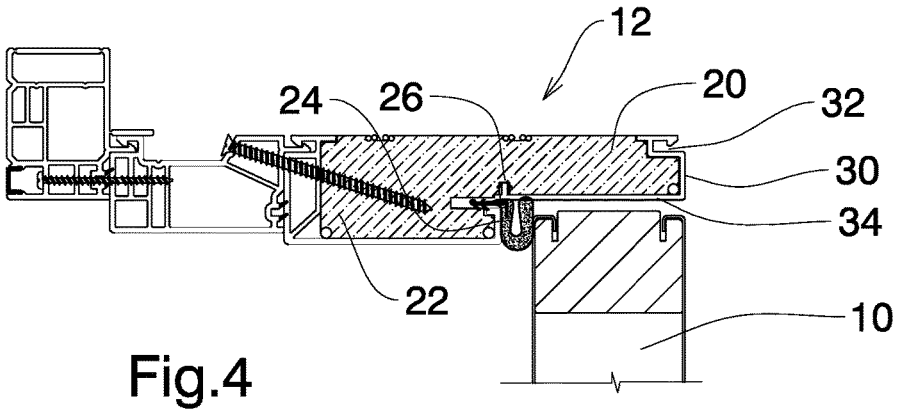
FIG. 4 is an enlarged section of the top frame assembly of FIG. 2, indicated in the circle 4.
Figure 5:
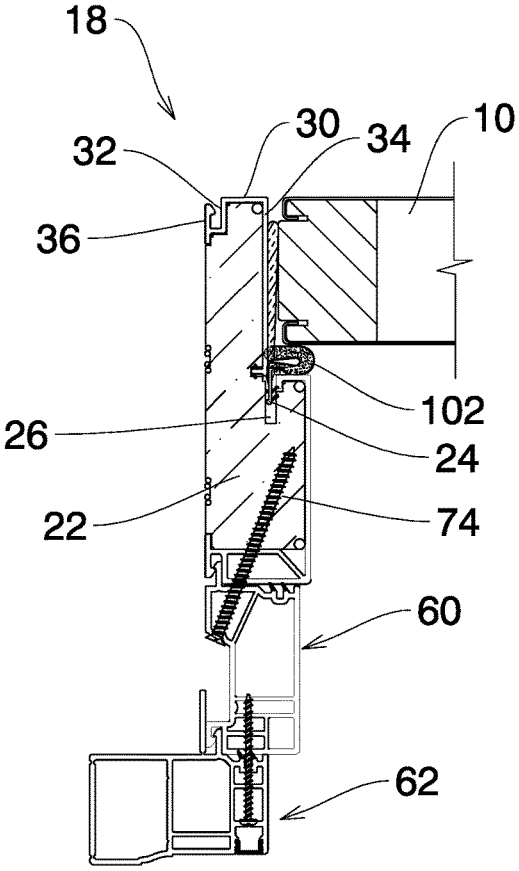
FIG. 5 is an enlarged section of the open side frame assembly of FIG. 3 indicated in the circle 5.
Figure 6:
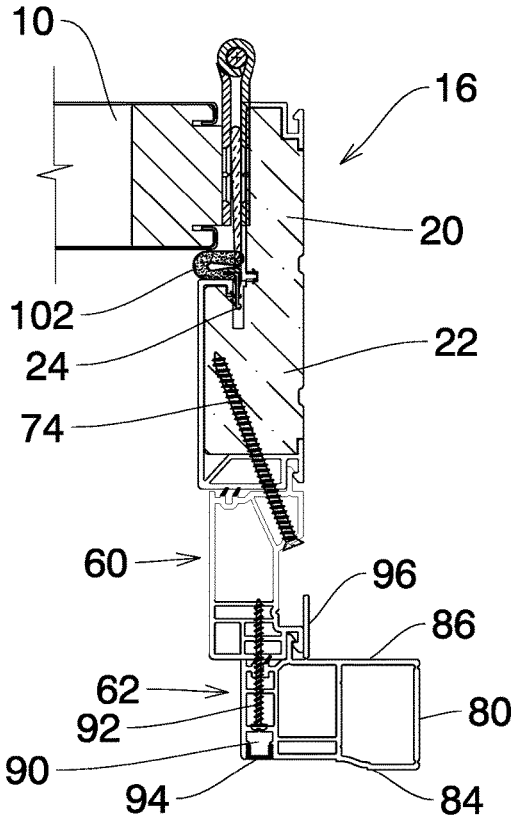
FIG. 6 is an enlarged section of the hinge side frame assembly of FIG. 3 indicated in the circle 6.

Referring now to FIGS. 4, 5, and 6, it will be seen that there are illustrated the top (12) and hinge side door frame (16) and the open or latch side door frame (18) components in greater detail. All three door frame components are essentially similar, in so far as concerns the cladding. The same parts are therefore given the same reference numbers.

Figure 7:
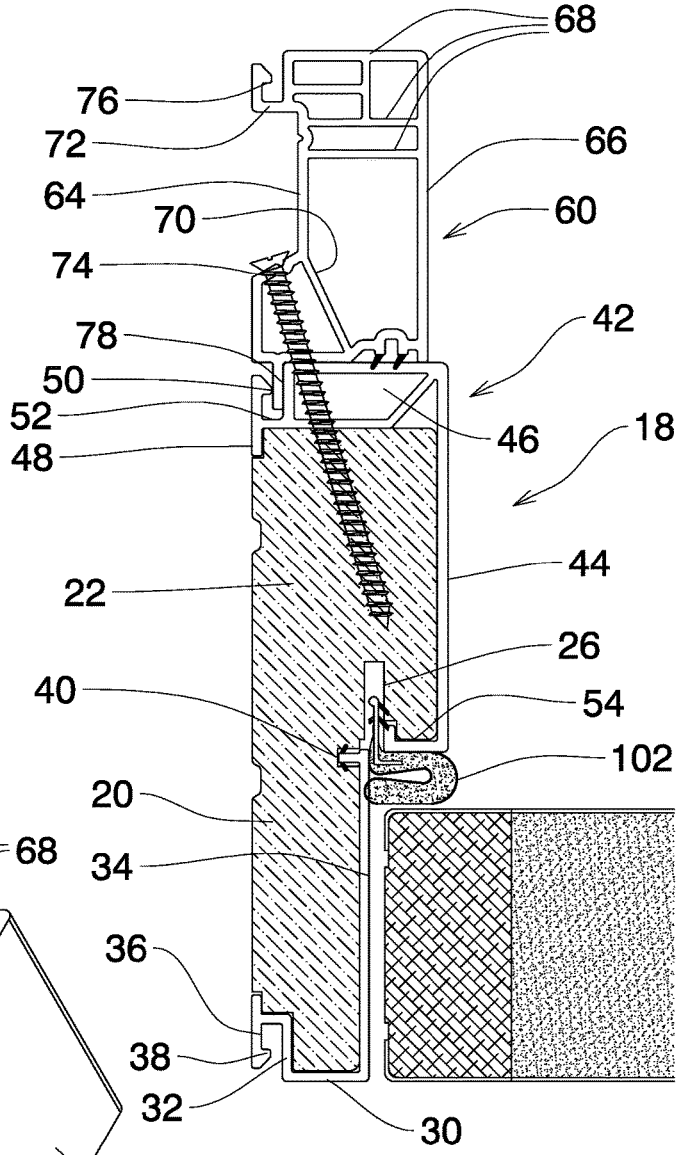
FIG. 7 is a greatly enlarged section of the open side frame assembly of FIG. 5.
Figure 8:
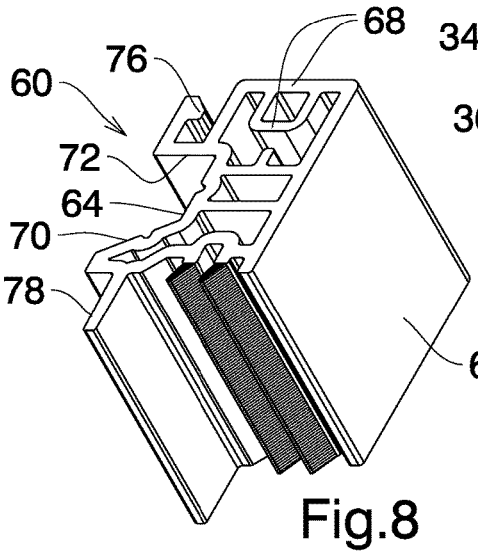
FIG. 8 is a perspective of one of the cladding component extensions.

The open door frame component (18) of FIGS. 5 and 7 comprises a wooden core defining an interior core portion (20), and an exterior core portion (22). The exterior core portion (22) is thicker than interior core portion (20). It provides an integral shoulder or stop (24), against which the door (10) will abut when the door is closed.

A fastening slot (26) is formed in shoulder (24) for reasons to be described below.

In this case the wooden core is shown enclosed both on the interior and on the exterior portions by synthetic cladding.

The interior cladding component defines a facing wall (30), and a shorter channel side wall (32), and a longer channel side wall (34) of greater length than the shorter channel side wall (32). The shorter and the longer walls are parallel to each other. The shorter channel side wall (32) forms a lock channel (36), having a hook (38). Any suitable interior trim piece (not shown) can be inserted into the lock channel (36). The hook (38) of the lock channel is co-planar with the outer surface of the interior wooden core (20). The longer channel side wall (34) extends across substantially the full extent of the inwardly directed surface of the interior portion (20) of the wooden core. A rectangular flange (40) is formed at the end of the longer channel side wall (34). In this way, the interior portion (20) of the wooden core is substantially enclosed by the cladding, at least where it is exposed to view.

The outwardly directed surface of the interior wooden core is left exposed, since it will be attached substantially directly to the building fabric by any suitable attachment means (not shown) such as are well-known in the building trades.

The exterior portion (22) of the wooden core is enclosed by a separate exterior synthetic cladding component, separate from the interior component and comprising a hollow tubular cladding portion (42), having an exposed cladding wall (44), extending over the extent of exposed exterior thicker wooden core portion (22). The tubular cladding component can vary in size to provide jamb depth flexibility. The longer cladding wall (44) is formed with a generally hollow tubular shaped cladding portion (46).

The hollow tubular cladding portion (46) terminates in a T-shaped wall (48), lying co-planar with the outwardly directed surface of the exterior wooden core portion (22).

One arm of the T-shape (48) defines a hook (50), and a locking channel (52). The other arm of the T-shape (48) overlaps the corner of the exterior wooden core portion (22). Along the opposite edge of the exterior cladding component, there is a rectangular flange (54) which fits within the corresponding groove formed in the exterior wooden core portion.

In the embodiment shown, there are two trim extensions indicated generally as (60) and (62). These would be typically used on the exterior of the building to fit against the edge of the building fabric which may be brick or block, or any other suitable construction.

The extension (60) comprises a complex tubular extrusion defining an outer wall (64) and an inner wall (66) parallel to one another, and transverse reinforcing walls (68) defining various reduced size tubular sections.

A diagonal interior channel wall (70) defines a four sided irregular tube. It will be noted that the outer wall (64) is indented into trim extension (60), and there is a perpendicular side wall (72) on its opposite edge, defining a 3-sided channel. The 3-sided channel enables the use of the diagonally angled screw fastening (74), passing through the diagonal channel wall, and into the exterior wooden core portion (22). This holds the trim extrusion (60) firmly against the exterior cladding.

A hook wall (76) is formed on wall (72).

In order to provide weather stripping, the trim extrusion (60) is provided with two flexible weather strips, which contact the outside of the exterior cladding.

The trim extrusion (60) is also provided with a locking flange (78), inter engaging with hook (50) on the T-shaped wall of the exterior cladding.

A second exterior trim extrusion (62) in this embodiment is attached to the first exterior trim extrusion (60). The second exterior trim extrusion comprises a tubular construction defined by two sidewalls (80) which are parallel, and two transverse interior walls within the two sidewalls. A top wall (84) is provided and a bottom wall (86) is provided parallel to the two interior walls.

For the sake of security, further transverse walls are provided, and open channel (90) is formed. In this way screw fastening (92) can be fastened inside the channel across the two walls and into the first extrusion (60).

A channel closure strip (94) is provided to close up the channel.

Second extrusion (62) also has a locking flange (96). This inter engages with hook (76) on the first trim extrusion. A planar cap wall on the second extrusion overlies the hook wall (76) of the first extrusion. In this way the second extrusion is securely and permanently fastened to the first extrusion. Preferably, the second extrusion is provided with flexible co-extrusions for the purpose of weather stripping, engaging the exterior of the first extrusion, on either side of the screw fastening (74).

In order to provide weather proofing between the door (D) and the frame, the exterior portion (24) of the wooden core is provided with slot (26), parallel with the underside of the wooden core. Within this slot a strip (102) of suitable weather stripping is provided with an L-shaped fastening body, on which the weather strip is attached. Once attached, the weather strip will be engaged by the door every time the door is closed, providing weather proofing between the edges of the door and the door frame.

Similar separate interior and exterior cladding components can also be used in cladding for frames for sidelite panels and for sidelite glass.

Figure 9:
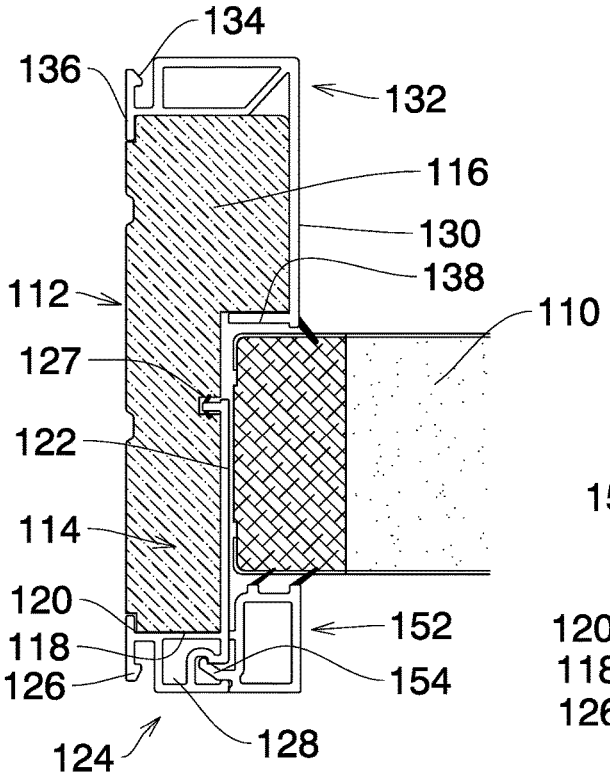
FIG. 9 is a section of a frame assembly showing the construction and assembly of a sidelite panel.

FIG. 9 shows a section of a fixed sidelite panel (110), supported in a wooden frame core (112) and separate interior and exterior cladding components (114) and (116). The wooden core in this case does not require the groove for the weather stripping, but is otherwise of similar construction to the wooden cores shown in FIGS. 4 to 8.

The interior cladding component, in this embodiment is shown as having a channel face wall (118), a shorter channel side wall (120) and a longer channel side wall (122) similar to the embodiments of FIGS. 4 to 8.

However, in this case an additional tubular interior edge portion (124) is formed integrally with the channel face wall (118). The edge portion (124) comprises a tubular member, having a hook wall (126) on the one side of the tubular member. On the other side of the tubular member, there is the locking channel (128), formed for reasons to be described below.

Interior cladding wall (122) has a flange (127) which engages a slot in the wooden core to lock the cladding.

The exterior cladding is defined by a longer side wall (130), and a tubular outer portion (132). A retention channel on the edge of the tubular portion has a hook (134). A T-shaped flange (136) extends from the hook (134). One arm of the T-shaped flange provides a shorter side wall extending along the outward edge of the exterior cladding, thereby locking the exterior cladding to the exterior wooden core portion.

Along the inner edge of the exterior cladding longer wall (130) there is a rectangular flange (138) which engages and locks on the exterior wooden core portion.

It will thus be seen that the interior cladding and the separate exterior cladding substantially enclose the wooden core, along the inwardly directed surfaces. The outwardly directed surfaces of the wooden core are free of cladding, and would normally be attached directly to the building fabric.

The sidelite panel (110) abuts against the rectangular flange of the exterior cladding. The inwardly directed surface of the panel (110) is retained by a generally rectangular tubular lock strip (152) having a hook (154). The hook (154) is received in the locking channel of the interior cladding.

Soft co-extrusions, as weather stripping, are provided on both the longer wall of the exterior cladding and also the locking channel of the interior cladding to engage the sidelite panel.

Figure 10:
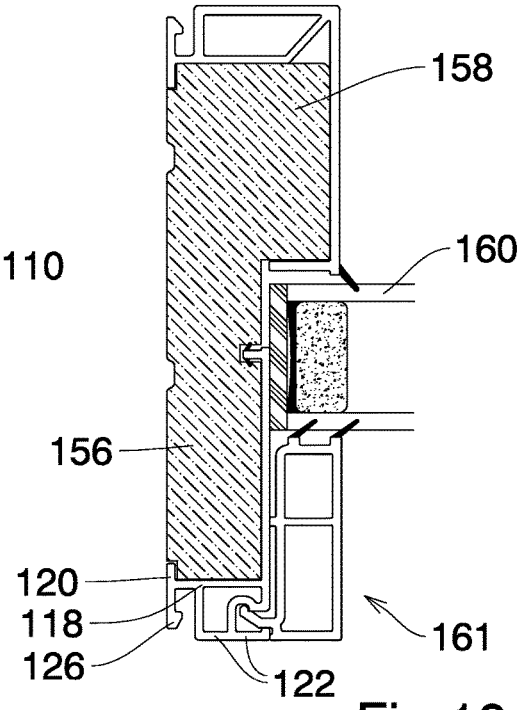
FIG. 10 is a section of a frame assembly similar to FIG. 9 but showing the attachment and construction and assembly of a sidelite glass panel.
Figure 12:
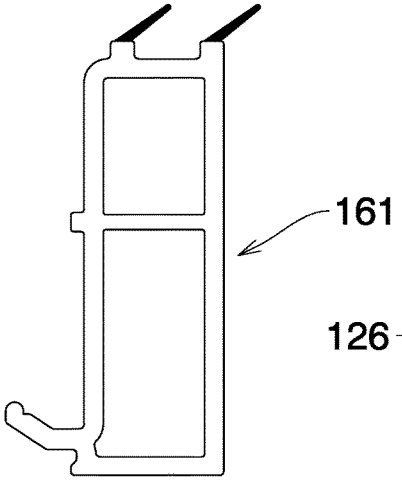
FIG. 12 is a section of a sidelite glass panel stop cladding component of FIG. 10.
Figure 11:
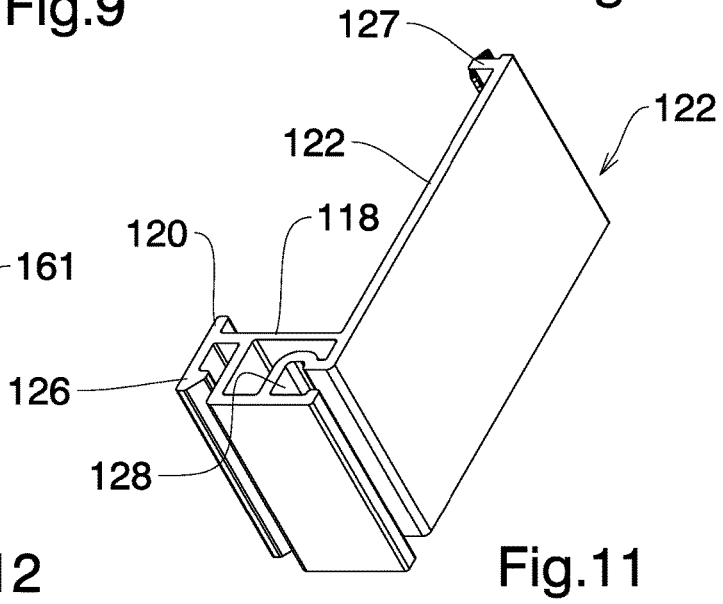
FIG. 11 is a perspective of a sidelite internal cladding component of FIG. 10.

A generally similar arrangement can be provided for holding a sidelite glass, as shown at FIG. 10. In this embodiment, the wooden core defines a thinner interior core portion (156) and a thicker exterior portion (158) forming a shoulder or stop against which the sidelite glass panel can be secured. The sidelite glass panel (160) consists typically of two layers of glass. Typically the interior of the Sidelite glass panel will be filled with argon. This effectively minimizes the heat transfer through the glass panel in a manner well-known in the art and industry.

The sidelite glass panel is held in position by a lock strip (161), engaging the interior cladding. Typical weather seals are provided on the exterior cladding and on the lock strip for engaging the sidelite glass panel in the manner described above.

Figure 13:
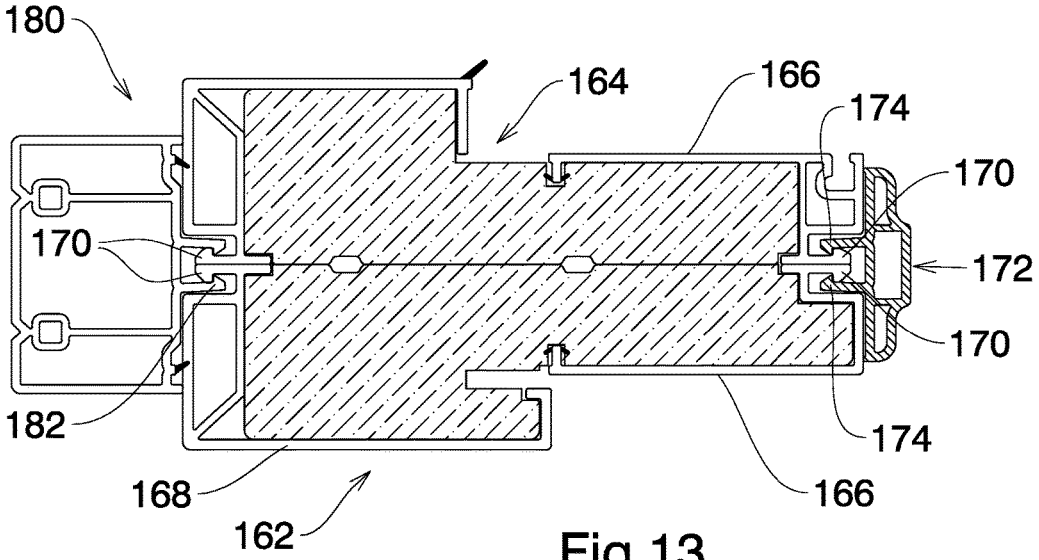
FIG. 13 is a section of another, thicker door frame/sidelite frame assembly component, with cladding.
Figure 14:
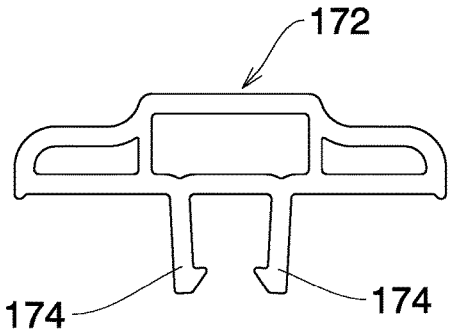
FIG. 14 is a section of a door frame/sidelite frame interior connection cladding component of FIG. 13.
Figure 15:
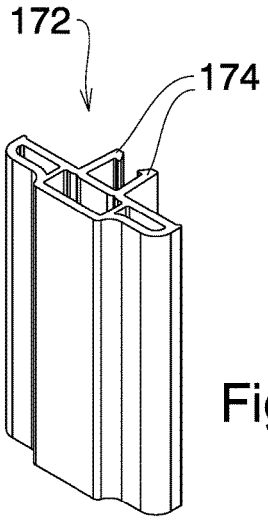
FIG. 15 is a perspective of FIG. 14.

In some cases it may be desirable to increase the strength of the frames. In this case, as shown in FIGS. 13,14 and 15 two wooden core portions indicated separately as (162) and (164) can be placed face to face. As shown in FIG. 13 the one wooden core portion (162) is designed to receive and hold a door (not shown). This wooden core is provided with interior cladding (166) and exterior cladding (168) generally similar to that described above. The other wooden core (164) is shown with a milled formation similar to FIGS. 9 and 10.

The two wooden cores (162) and (164) and their respective cladding components are secured together by interior lock members (170), and lock extrusion (172) formed with a pair of lock walls (174).

This makes a structural engagement between the lock members (170) on the interior cladding portions (166).

An exterior locking extrusion (180) is formed with a similar pair of locking walls (182), engaging the lock strips on the two exterior cladding portions (168).

If desired, the two wooden cores (162) and (164) can be secured together by suitable fastenings (not shown) or even by an adhesive.

The exterior locking extrusion (180) is preferably provided with soft co-extrusions as weather stripping blades.

Figure 16:
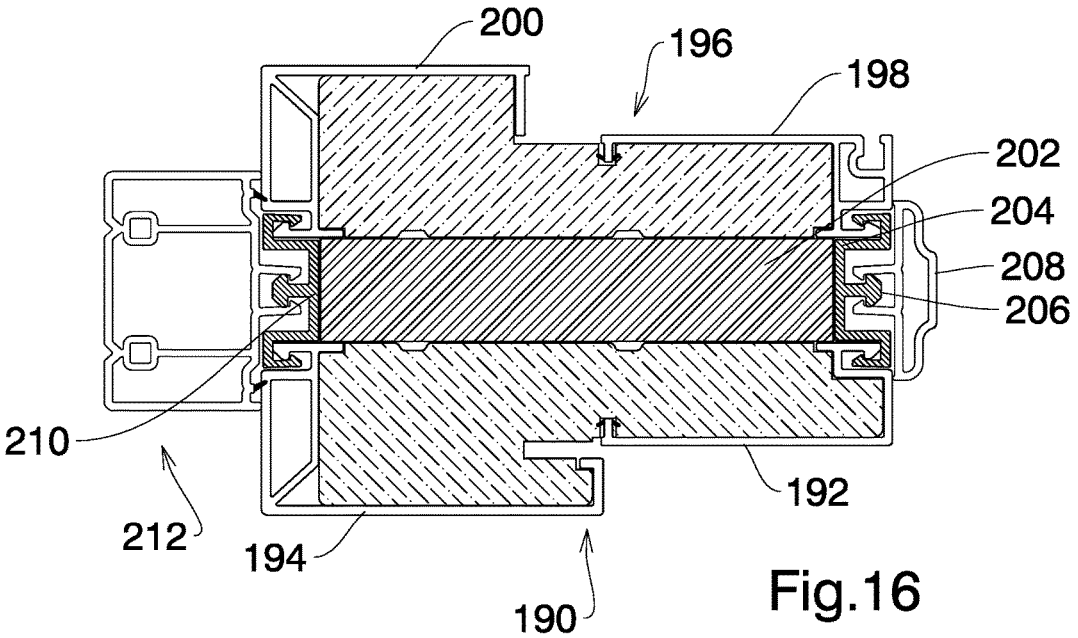
FIG. 16 is a section of a door frame/sidelite frame assembly when additional filler/support is required; therefore it is thicker than the assembly of FIG. 13.
Figure 17:
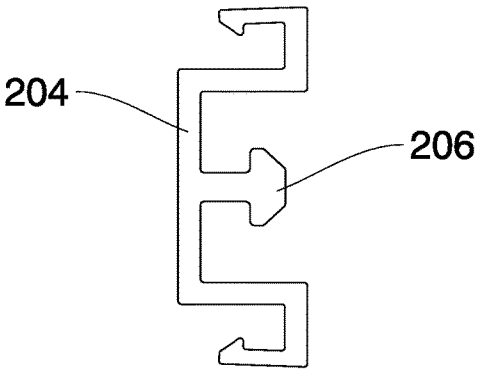
FIG. 17 is a section of a filler/support adapter cladding component of FIG. 16.
Figure 18:
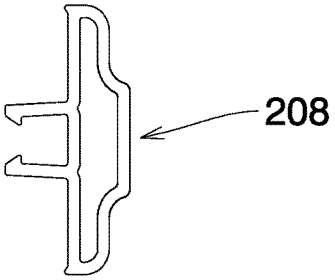
FIG. 18 is a section of another cladding component of FIG. 16, shows unification and how the same door/sidelite frame interior connection is applied to the filler/support adapter cladding component.

Referring to FIGS. 16, 17 and 18, a further embodiment of framing is disclosed. In this case, a door frame wooden core (190) is provided on one side, with suitable interior cladding (192) and exterior cladding (194). A sidelite wooden core frame (196) is provided, having interior cladding (198) and exterior cladding (200), separate from the interior cladding.

Between the two wooden frame cores there is provided an additional reinforcement/structural member (202), which may be wood or may be composite material for example.

In this case, due to the increased overall thickness of the combination of core frames, there is an interior locking extrusion (204) provided for locking the two interior claddings (192) together on the interior, and a cover trim extrusion is provided, similar to the locking extrusion of FIGS. 13, 14 and 15. In this case, the locking extrusion is provided with the single central lock wall (206), which will be engaged by the trim extrusion (208). An exterior locking extrusion (210) is provided, identical to the interior locking extrusion (204) already described. The exterior locking extrusion will engage the two exterior claddings (194) and (200). An exterior trim member (212) having locking arms will lock against the central locking wall of the exterior locking extrusion (210).

Figure 19:
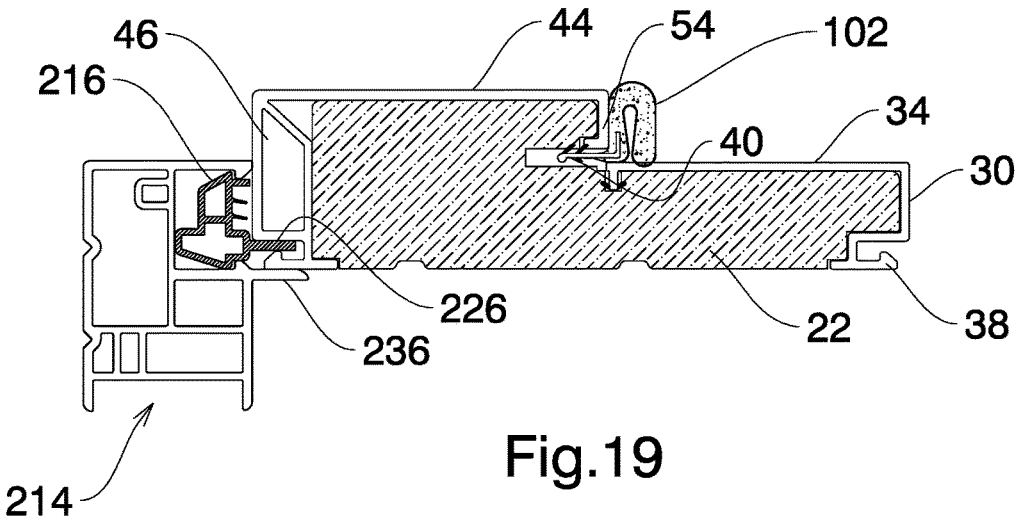
FIG. 19 is a section of another embodiment, showing a trim system assembly modification of the exterior trim portions of door frame system.
Figure 20:
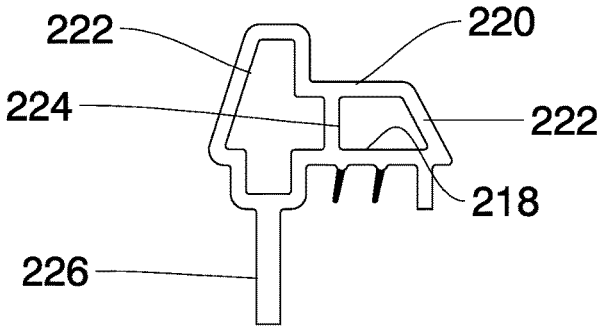
FIG. 20 is a section of a modified trim system adapter of the trim portions of FIG. 19.
Figure 21:
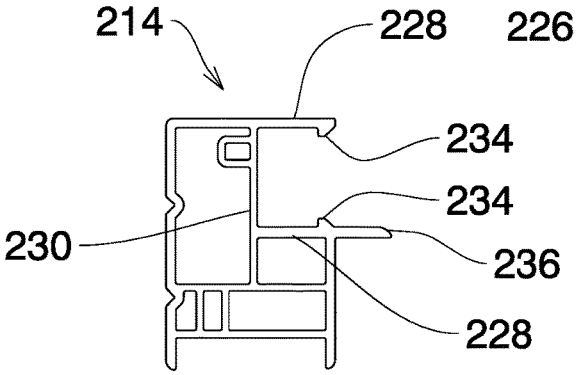
FIG. 21 is a section of a modified exterior trim system closure/cap of the trim portions of FIG. 19.

There may be several ways in which to attach an exterior trim extrusion (214) to the exterior cladding components for the door frame. One such alternative system is shown in FIGS. 19, 20 and 21. In this case, the reference numbers already used in FIGS. 4 to 8 are repeated. The wooden core has an interior core portion and exterior core portion, and a shoulder milled between the two.

An interior cladding encloses interior core portion and a separate exterior cladding encloses the exterior core portion.

In this modification, the exterior trim extrusion (214) can be attached to the exterior cladding, by means of attachment extrusion (216). The extrusion (216) (FIGS. 19 and 20) has an inner side wall (218) and an outer side wall (220) in two parts, defining a shoulder. Angled outer walls (222) extend between the inner and outer walls. An interior reinforcing wall (224) extends between the inner and outer side walls.

A locating wall (226) extends from the inner wall (218). Two soft co-extrusions comprising weather strip blades also extend from the inner wall (218), for contacting and sealing against the outside surfaces of the exterior cladding. The trim extrusion (214) is formed with a 3-sided channel having side walls (228) and a transverse wall (230).

Fastening/engaging hooks (234) are formed along the two side walls. A locating wall (236) extends down from one of the side walls of the channel.

In use, the attachment extrusion (216) of FIGS. 19 and 20 is secured to the exterior cladding of the door frame, typically by a screw (238) FIG. 19. The screw head has a clearance defined by the extrusion (216).

The locating wall (226) fits into the locking channel of the exterior cladding components. The locating wall of the trim extrusion (214) fits outside the side of the exterior cladding. The exterior trim extrusion (214) can then be forced onto and snapped over the attachment extrusion (216).

The angling of the two side walls facilitates this movement, by progressively spreading the two side walls of the exterior trim extrusion (214). It will be appreciated that this modification removes the need for the open channel and screw fastening, and the channel cover strip provided to close up the channel, described above.

In use the interior and exterior cladding components are individually and separately snap fitted onto their wooden frame parts.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A plastic cladding for a wooden frame for a building fabric opening, the wooden frame having a top frame wooden part, and respective side frame wooden parts on opposite sides of the opening, each said wooden frame part having a building interior wooden portion of a first thickness and a building exterior wooden portion of a second thickness greater than said first thickness, wherein each wooden frame part has a generally planar outer surface in contact with a building fabric and wherein each wooden frame part defines an inner surface, and wherein said plastic cladding, which can be selectively and separately attached to the wooden frame parts, comprise:

an interior cladding component, for said interior wooden portion of each said wooden frame part;

an interior rectangular channel extending along an edge of said interior cladding component for fitting around said interior wooden portion of each said wooden frame part;

an exterior cladding component, separate from said interior cladding component, for said exterior wooden portion of each said wooden frame part;

an exterior rectangular channel extending along an edge of said exterior cladding component, said channel fitting around an edge of said exterior wooden portion of each said wooden frame part;

wherein a longer channel side wall on each exterior cladding component extends across substantially the full extent of the inner surface of the exterior portion of the wooden frame part and an exterior rectangular flange is formed at the end of the longer channel side wall and an exterior retention groove is formed in an inner surface of said exterior portion of said wooden frame part receiving said rectangular flange;

wherein each exterior cladding component includes a hollow tubular cladding portion, and has an exposed cladding wall extending over the exterior portion of said wooden frame part;

wherein the hollow tubular cladding portion of said exterior cladding component terminates in a T-shaped wall, lying co-planar with the outer surface of said exterior portion of said wooden frame part;

wherein said T-shaped wall has two arms and wherein one arm of the T-shaped wall defines a hook, and a locking channel, and the other arm of the T-shaped wall overlaps a corner of the exterior portion of said wooden frame part;

wherein each said cladding component has a shorter channel side wall of a first length and the longer channel side wall of greater length than the shorter channel side wall parallel to one another and spaced apart and a channel base wall there between;

an interior retention groove formed in an inner surface of said interior portion of said wooden frame part; and an interior rectangular flange formed at the end of the longer channel side wall of said interior rectangular channel received in said interior retention groove;

wherein the shorter channel side wall defines a lock corner, having a hook wall;

wherein the hook wall of the lock corner is co-planar with said outer surface of each said wooden frame part.

2. The plastic cladding for a wooden frame for a building fabric opening as claimed in claim 1 including a weather strip retention slot formed in the exterior portion of said wooden frame part.

3. The plastic cladding for a wooden frame for a building fabric opening as claimed in claim 2 including an extension of said hook wall, wrapping around an edge of said interior portion of said wooden frame.

4. The plastic cladding for a wooden frame for a building fabric opening as claimed in claim 3 including a first exterior trim member attachable to said exterior cladding component, said first exterior trim member having a planar surface abutting against said exterior cladding component, and weather strips incorporated in said planar surface, and wherein said first exterior trim member defines a recess, said recess having a diagonal wall, and a fastener extending through said diagonal wall into said wooden frame part.

5. The plastic cladding for a wooden frame for a building fabric opening as claimed in claim 4 wherein said exterior cladding component defines a locking channel, and wherein said first exterior trim member has a first exterior locking flange extending from said planar surface, and received in said locking channel of said exterior cladding component.

6. The plastic cladding for a wooden frame for a building fabric opening as claimed in claim 4 including a second exterior trim member attached to said first exterior trim member and forming an edge filler component fitting against said building fabric.

7. The plastic cladding for a wooden frame for a building fabric opening as claimed in claim 6 wherein said first exterior trim member defines a locking channel, and wherein said second exterior trim member defines a second exterior locking flange, received in said first exterior trim member locking channel.

8. The plastic cladding for a wooden frame for a building fabric opening as claimed in claim 7 wherein said second exterior trim member defines a second exterior fastening channel and weather strips, and a fastener extending from said second exterior trim member fastening channel through said weather strips into said first exterior trim member, and including a cover strip in said second exterior fastening channel.

9. The plastic cladding for a wooden frame for a building fabric opening as claimed in claim 1 wherein said interior cladding component has a tubular formation formed thereon by said side walls and said end wall, defining an interior locking channel there along, and wherein said building opening is an opening for a building fabric panel, and including an interior fastening member of synthetic material defining an inner end having sidewalls spaced apart to define a tube there between, an interior locking flange extending from said interior fastening member received in said interior locking channel of said interior cladding component, and having a plurality of weather strips formed along one said side wall, engaged with said building fabric panel.

10. The plastic cladding for a wooden frame for a building fabric opening as claimed in claim 1 including a second wooden frame part having interior and exterior frame portions, placed face to face with said first wooden frame part, and including a second interior cladding component attached to said interior portion of said second wooden frame part, and a second exterior cladding component attached to an exterior portion of said second wooden frame part, and an interior cladding fastening member engaged between both said interior cladding components, and an exterior cladding fastening member engaged with both said exterior cladding components.

11. The plastic cladding for a wooden frame for a building fabric opening as claimed in claim 10 wherein said interior cladding components define respective side by side interior cladding locking channels, and define respective locking abutments, and wherein said exterior cladding components define exterior cladding locking channels and respective locking abutments, and wherein said interior locking member defines two interior arms engaged with said locking abutments on said interior cladding components, and wherein said exterior locking member defines two exterior arms, engaged with said exterior locking abutments of said exterior cladding components.

12. The plastic cladding for a wooden frame for a building fabric opening as claimed in claim 10 including a reinforcement panel between said first and second wooden frame parts, and including first connection members engaged with said interior cladding components on respective said wooden frame parts, and second connection members engaged with said exterior cladding components on said exterior wooden frame parts, and including trim members engaged with respective said connection members, and fitting along said interior cladding components, and along said exterior cladding components.

* * * * *